United States Patent [19]

Yamaguchi et al.

[11] 4,407,892

[45] Oct. 4, 1983

[54] HEAT SENSITIVE RECORDING SHEET

[75] Inventors: Akihiro Yamaguchi, Kamakura; Keizaburo Yamaguchi, Kawasaki; Hisamichi Murakami, Yokohama, all of Japan

[73] Assignee: Mitsui Toatsu Chemicals, Incorporated, Tokyo, Japan

[21] Appl. No.: 400,016

[22] Filed: Jul. 20, 1982

Related U.S. Application Data

[63] Continuation of Ser. No. 229,562, filed as PCT JP80/00135, Jun.18, 1979, published as WO80/02820, Dec. 24, 1980, § 102(e) date Jan. 2, 1981, abandoned.

[30] Foreign Application Priority Data

Jun. 18, 1979 [JP] Japan ..... 54-75623

[51] Int. Cl.[3] ..... B41M 5/18

[52] U.S. Cl. ..... 428/411; 428/913; 428/914; 427/151; 282/27.5; 106/21; 430/338

[58] Field of Search ..... 428/411, 913, 914, 307; 427/151; 282/27.5; 106/21; 430/338

[56] References Cited

U.S. PATENT DOCUMENTS

| | | | |
|---|---|---|---|
| 3,244,549 | 4/1966 | Farnham et al. | 282/27.5 |
| 3,244,550 | 4/1966 | Farnham et al. | 282/27.5 |
| 3,336,337 | 8/1967 | Gosnell | 260/343.4 |
| 3,560,229 | 2/1971 | Farnham | 106/21 |
| 4,226,912 | 10/1980 | Iwasaki et al. | 282/27.5 |
| 4,260,179 | 4/1981 | Yamaguchi et al. | 282/27.5 |
| 4,262,938 | 4/1981 | Yamaguchi et al. | 282/27.5 |

FOREIGN PATENT DOCUMENTS

| | | | |
|---|---|---|---|
| 2342758 | 10/1975 | Fed. Rep. of Germany | 282/27.5 |
| 46-409309 | 8/1961 | Japan | 282/27.5 |
| 54-106313 | 8/1979 | Japan | 282/27.5 |

OTHER PUBLICATIONS

Chem. Abstracts, vol. 92, No. 155910v, (1980).

*Primary Examiner*—Won H. Louie, Jr.
*Attorney, Agent, or Firm*—Fisher, Christen & Sabol

[57] ABSTRACT

Heat sensitive recording sheet having improved light resistance and water resistance. A developer contained therein is one or more specified metal salts of 2,2'-bisphenolsulfide, 2,2'-bisphenolsulfoxide and 2,2'-bisphenolsulfone compounds. The heat sensitive recording sheet can further contain a heat fusible material having a melting point of 50° to 190° C.

6 Claims, No Drawings

HEAT SENSITIVE RECORDING SHEET

This is a continuation of application Ser. No. 229,562, filed as PCT JP 80/00135, Jun. 18, 1979, published as WO 80/02820, Dec. 24, 1980, § 102(e) date Jan. 2, 1981, abandoned.

BACKGROUND OF THIS INVENTION

1. Field of This Invention

This invention relates to an improved heat sensitive recording sheet containing a novel developer.

2. Prior Art

A so-called dye color development type heat sensitive recording sheet is well known in the art. According to such system a coupler consisting of electron donative, color assuming compounds such as triphenylmethane series, fluoran series, phenothiazine series, auramine series, spiropyran series, and the like, (hereinafter simply referred to as coupler), and a developer consisting of a solid acid selected from clays such as activated clay, phenol compounds, aromatic carboxylic acids, aromatic polyvalent metal salts, and the like, are brought into contact with each other by heating to obtain a developed color image due to the application of the color reaction therebetween.

Generally, the heat sensitive recording sheet is required, as conditions for performance thereof which the sheet should possess in order to be colorless or light colored, to have a fast developed color image, to have excellent performance for color development immediately after the preparation of the sheet or after a long term storage of the sheet without any lowering thereof, to be sufficiently stable to light or moisture, and further to be capable of being prepared economically. The developer for heat sensitive recording, which has already been proposed, and sheets coated with the developer have both merits and demerits from the standpoint of performance. These sheets have such drawbacks that the color develops prior to reproduction heating to produce blushing because two reactants are brought into contact with each other to be coated on a substrate, that they have poor storage stability of a developed image due to such as light resistance and water resistance, and that the color does not develop instantly on heating - these factors show the need for an improved heat sensitive recording sheet. The color development property obtained by heating of 4,4'-isopropylidenediphenyl (bisphenol A), which is exclusively used at the present time, is clear, but the fastness properties to light of the developed color image are not satisfactory.

BROAD DESCRIPTION OF THIS INVENTION

An object of this invention is to provide an improved heat sensitive recording sheet.

Another object of this invention is to provide a heat sensitive recording sheet which gives a developed color image having an excellent fastness to light and water resistance.

A further object of this invention is to provide a heat sensitive recording sheet according to which a decrease in density of developed image by light with time is very little.

The present invention provides the following heat sensitive recording sheet:

A heat sensitive recording sheet prepared by coating a coupler, developer and binder on a sheet substrate, or by impregnating such therein, characterized in that said developer is one or more than one of the compounds represented by the general formula (I):

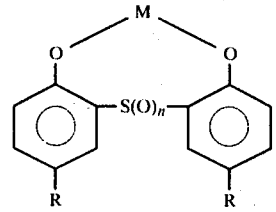

(I)

wherein each R represents hydrogen, an alkyl radical of 1 to 12 carbon atoms, a cycloalkyl radical of 3 to 10 carbon atoms, an aralkyl radical of 7 to 10 carbon atoms or a pheny radical, and may be identical to or different from each other, M represents polyvalent metals, except for Group IA of the Periodic Table, n is zero or an integer of 1 or 2.

The present invention further provides a heat sensitive recording sheet which contains one or more than one of the compounds represented by the general formula (I) as developer, and may further contain heat fusible materials which have a melting point of 50° to 190° C. and are substantially colorless at room temperature. The heat sensitive recording sheet containing these heat fusible materials generally more and more increases the rate of color development upon heating, and lowers the temperature of color development.

Best Mode of Carrying Out This Invention:

Examples of the compounds represented by the general formula (I) include, but not to be limited thereto,
zinc 2,2'-diphenolsulfide,
nickel 2,2'-diphenolsuflone,
zinc 2,2'-bis(p-cresol)sulfide,
zinc 2,2'-bis(p-tert-butylphenol)sulfide,
nickel 2,2'-bis(p-tert-butylphenol)sulfide,
zinc 2,2'-bis(p-tert-butylphenol)sulfone,
nickel 2,2'-bis(p-tert-butylphenol)sulfone,
zinc 2,2'-bis(p-tert-amylphenol)sulfone,
zinc 2,2'-bis(p-cyclohexyl)sulfide,
zinc 2,2'-bis(p-cyclohexyl)sulfoxide,
zinc 2,2'-bis(p-cyclohexyl)sulfone,
nickel 2,2'-bis(p-cyclohexyl)sulfone,
cobalt 2,2'-bis(p-cyclohexyl)sulfone,
zinc 2,2'-bis(p-cumylphenol)sulfide,
nickel 2,2'-bis(p-cumylphenol)sulfoxide,
Zinc 2,2'-bis(p-cumylphenol)sulfone,
magnesium 2,240 -bis(p-cumylphenol)sulfone,
nickel 2,2'-bis(p-cumylphenol)sulfone,
manganese 2,2'-bis(p-cumylphenol)sulfone,
zinc 2,2'-bis(p-phenylphenol)sulfide,
calcium 2,2'-bis(p-phenylphenol)sulfone,
nickel 2,2'-bis(p-phenylphenol)sulfone,
cobalt 2,2'-bis(p-phenylphenol)sulfone,
zinc 2,2'-bis(p-tert-octylphenol)sulfide,
nickel 2,2'-bis(p-tert-octylphenol)sulfide,
cobalt 2,2'-bis(p-tert-octylphenol)sulfide,
zinc 2,2'-bis(p-octylphenol)sulfoxide,
zinc 2,2'-bis(p-tert-octylphenol)sulfone,
nickel 2,2'-bis(p-tert-octylphenol)sulfone,
magnesium 2,2'-bis(p-tert-octylphenol)sulfone,
cobalt 2,2'-bis(p-tert-octylphenol)sulfone,
calcium 2,2'-bis(p-tert-octylphenol)sulfone,
barium 2,2'-bis(p-tert-octylphenol)sulfone,
zinc 2,2'-bis(p-dodecylphenol)sulfide, nickel 2,2'-bis(p-dodecylphenol)sulfide,
cobalt 2,2'-bis(p-dodecylphenol)sulfide,
zinc 2,2'-bis(p-dodecylphenol)sulfoxide,
calcium 2,2'-bis(p-dodecylphenol)sulfoxide,
nickel 2,2'-bis(p-dodecylphenol)sulfone,
magnesium 2,2'-bis(p-dodecylphenol)sulfone,
zinc 2,2'-bis(p-nonylphenol)sulfide,
magnesium 2,2'-bis(p-nonylphenol)sulfide,
calcium 2,2'-bis(p-nonylphenol)sulfoxide,
zinc 2,2'-bis(p-nonylphenol)sulfone,
chromium 2,2'-bis(p-nonylphenol)sulfone,
nickel 2,2'-bis(p-nonylphenol)sulfone,
cadmium 2,2'-bis(p-nonylphenol)sulfone,
magnesium2,2'-bis(p-nonylphenol)sulfone, and the like.

The developer represented by the general formula (I) as mentioned above can be prepared by a process such as that described below. For example, the developer is prepared by reacting an alkali metal salt of one member selected from bisphenol compounds consisting of 2,2'-bisphenolsulfide, 2,2,'-bisphenolsulfoxide, and 2,2'-bisphenolsulfone compounds, and a water soluble polyvalent metal salt in a solvent in which both salts are soluble. That is, the developer is prepared by a process in which one gram equivalent of the bisphenol compound is reacted with 2 gram equivalents or more of hydroxides, alkoxides, or the like of alkali metal to form an alkali metal salt of bisphenol compounds, or an aqueous solution, alcohol solution or water-alcohol mixed solution thereof, and then one gram equivalent or more of the water soluble polyvalent metal salt is reacted therewith to form the developer.

Examples of the water soluble polyvalent metal salt used for the preparation of the developer employed in the present invention include chlorides, salts with inorganic acids such as sulfuric acid and nitric acid, salts with organic acids such as oxalic acid and acetic acid, and the like of polyvalent metals (except for Group IA of the Periodic Table) such as magnesium, calcium, aluminium, zinc, tin, nickel, barium strontium, cadmium, manganese, cobalt, chromium, and the like.

The heat fusible material used in the present invention is a solid which is colorless at room temperature, or is almost colorless to such an extent that no feeling of color development is substantially obtained when impregnated in the heat sensitive recording sheet. The heat fusible material has a sharp melting point at a temperature suitable for recording on reproduction recording, that is, at a temperature in the neighbourhood of 50° to 190° C. The heat fusible material dissolves either one or both of a coupler and a developer represented by the general formula (I) at a fused state thereof. Examples of the heat fusible material used include acetanilide, urea, diphenylamine, biphenyl, naphthalene, α-napthol, β-naphthol, bisphenol A, 4,4-cyclohexilidenediphenol, phthalic anhydride, benzoic acid, phthalic acid, methyl p-hydroxybenzoate, stearic acid, zinc stearate, ethyleneglycol ester stearate, triphenylphosphates, 2,2'-bisphenol sulfides, 2,2'-bisphenol-sulfoxides, and 2,2'-bisphenolsulfones.

A typical process for the preparation of the heat sensitive recording sheet of the present invention is described below. The coupler usable in the present invention includes various materials which develop color by a fusion reaction thereof with a developer represented by the general formula (I). Examples of the coupler include electron donating and color assuming compounds such as 3,3'-bis(4-dimethylaminophenyl)-6-dimethylaminophthalide (crystal violet lactone), 3-diethylamino-6-methyl-7-chlorofluoran, 3-diethylamino-7-chlorofluoran, 3-cyclohexylamino-6-chlorofluoran, 3-diethylamino-7-dibenzylaminofluoran, 3-diethylamino-6-methyl-7-phenylaminofluoran, 1,3,3-trimethylindolino-6'-chloro-8'-methoxyspiropyran, 3-methyl-2,2'-spiro bis(benzo[f] chromene), and the like.

A colorless or light colored coupler as described above, a developer represented by the general formula (I), or a mixture of a coupler, developer, and a heat fusible material is thoroughly mixed with a solution prepared by dissolving a binder in water or an organic solvent, or with a dispersion of the binder therein to prepare a mixed solution.

Examples of the binder used for the preparation of the mixed solution include synthetic polymers such as styrene butadiene polymer, polyvinylalcohol, carboxymethylcellulose, hydroxyethylcellulose, polystyrene, vinylchloride-vinylacetate copolymer, and acacia, and natural or modified natural polymers. Examples of the solvent used include organic solvents such as benzene, toluene, acetone, methylene chloride, ethyl acetate, and cyclohexane, and water.

The mixed solution thus obtained is coated (subsequently to be dried) on a substrate such as paper, natural or synthetic resin film, and the like. The mixed solution may be allowed to flow into the substrate in order to be impregnated therein. The method of mixing and method of coating described above are not limited to the heat sensitive recording sheet of the present invention. For example, the coupler and/or the heat fusible material are mixed with a binder solution, and separately the developer and/or the heat fusible material are mixed with a binder solution. Then both mixtures thus obtained may be mixed together for coating on the substrate, or these two mixtures may be separately coated on the substrate to be coated. Both mixtures may be coated on the same surface of the substrate or on surfaces separate from each other, or may be coated on different substrates respectively.

The coating weight is generally above $0.5g/m^2$, preferably in the range of 1 to $10g/m^2$, on dry weight basis.

The relative amount of each component of the heat sensitive recording sheet is widely variable, but suitably is in the range of 1 to 15 parts by weight of the coupler, 1 to 95 parts by weight of the developer represented by the general formula (I), 1 to 40 parts by weight of the binder, and zero or 0.5 to 200 parts by weight of the heat fusible material, all on dry weight basis.

According to the heat sensitive recording sheet of the present invention, the coupler and developer are brought into contact with each other, while they are prepared, coated, and dried before being heated. Nevertheless, the heat sensitive recording sheet of the present invention has such advantages that no blushing occurs due to color development, that stability thereof with time is kept at a high level without any lowering in color development performance by exposure thereof to light before reproduction, that the color development is effected instantly on heating, and that the developed image has excellent light resistance and water resistance.

The present invention is further explained by the following Examples.

The methods of measurement and assessment for various performances of the recording sheet are shown below.

(1) Developed color density:

A recording sheet is subjected to heat color development under the following conditions,

| | |
|---|---|
| heating time | 5 seconds |
| pressure between heating material and recording sheet on heating | 10 g/cm$^2$ |
| heating temperature range | 60° to 180° C. |

by use of Thermotest.Rhodiaceta (manufactured by SETARAM Co.; Type 7401).

Reflectance (I) is measured in 10 minutes after color development by heating by use of an amber filter for TSS type Hunter color difference meter (manufactured by Toyo Seiki Co., Ltd.). The lower the reflectance is, the higher the developed color density becomes.

(2) Fade resistance to light of developed image:

A sheet developed according to the procedure in (1) is lighted for a time period of 30 minutes to 6 hours by use of a carbon arc lamp, and the following reflectances are measured by use of Hunter color difference meter in the same manner as in (1).

Io:reflectance of sheet before color development,

Is:reflectance of color developed sheet before lightening,

In:reflectance of color developed sheet n hours after lightening.

The fade resistance to light of the developed image is represented by use of the above reflectances as:

$$\text{Degree of residue} = \frac{In}{Io - In} \Big/ \frac{Is}{Io - Is} \times 100(\%)$$

A higher degree of residue is preferable.

(3) Storage stability:

A sheet before color development and a color developed sheet are stored 6 months at 25° C., and the reflectance of the sheet before color development and that of the color developed sheet before storage are represented by Ko and Ko' respectively, and those after storage are represented by K and K' respectively. The smaller the values of the differences of K–Ko and K'–Ko' are, the more the storage stability, which is preferable.

(4) Water resistance:

A color developed recording sheet is kept in water for 2 hours, and a change in color density of a color developed image is observed with the naked eye.

EXAMPLE 1

| | | |
|---|---|---|
| Solution A: | crystal violet lactone | 7 g |
| | 10 wt % polyvinylalcohol (Kurare # 217) | 30 g |
| | water | 13 g |
| Solution B: | nickel 2,2'-bis(p-tert-octylphenol)sulfone | 7 g |
| | 10 wt % polyvinylalcohol | 30 g |
| | water | 13 g |

Dispersions are prepared separately from solution A and B respectively by use of a sand grinding mill, and two separate dispersions are mixed at a ratio of 3 parts of solution A to 67 parts of solution B. The mixture is coated on fine paper and dried so that the coating weight may be in the range of 2.5 to 3.5 g/m$^2$ on dry basis to obtain a heat sensitive recording sheet.

EXAMPLE 2

| | | |
|---|---|---|
| Solution A: | crystal violet lactone | 7 g |
| | 10 wt % polyvinylalcohol | 30 g |
| | water | 13 g |
| Solution B: | nickel 2,2'-bis(p-tert-octylphenol)sulfone | 7 g |
| | zinc stearate | 7 g |
| | 10 wt % polyvinylalcohol | 60 g |
| | water | 26 g |

Both above solutions are subjected to the same procedure as in Example 1 to prepare dispersions, and the dispersions thus obtained are mixed at a ratio of 3 parts of solution A to 134 parts of solution B. The mixture is coated on a fine paper and dried so that the coating weight may be in the range of 2.5 to 3.5 g/m$^2$ on dry basis to obtain a heat sensitive recording sheet.

EXAMPLE 3

| | | |
|---|---|---|
| Solution A: | crystal violet lactone | 7 g |
| | 10 wt % polyvinylalcohol | 30 g |
| | water | 13 g |
| Solution B: | nickel 2,2'-bis(p-tert-octyl)sulfone | 4.9 g |
| | bisphenol A | 2.1 g |
| | 10 wt % polyvinylalcohol | 30 g |
| | water | 13 g |

Both above solutions are subjected to the same procedure as in Example 1 to prepare dispersions, and the dispersions thus obtained are mixed at a ratio of 3 parts by weight of solution A to 67 parts by weight of solution B. The resultant mixture is coated and dried so that the coating weight may be in the range of 2.5 to 3.5 g/m$^2$ on dry basis to obtain a heat sensitive recording sheet.

COMPARATIVE EXAMPLE

The procedure of Example 1 is repeated except that bisphenol A is used instead of the nickel 2,2'-bis (p-tert-octylphenol)-sulfone in Example 1 to obtain a heat sensitive recording sheet.

EXAMPLES 4 to 9

The procedure of Example 1 is repeated four times except that nickel 2,2'-bis(p-tert-butylphenol)sulfide (Example 4), zinc 2,2'-bis(p-tert-butylphenol)sulfoxide (Example 5), magnesium 2,2'-bis(p-tert-octylphenol)sulfone (Example 6), and cobalt 2,2'-bis(p-tert-octylphenol)sulfone (Example7), respectively, is used instead of the nickel 2,2'-bis(p-tert-octylphenol)-sulfone in Example 1 to obtain heat sensitive recording sheets.

Further, the procedure of Example 2 is repeated by using calcium 2,2'-bis(p-tert-butylphenol)sulfone (Example 8), and nickel 2,2'-bis(p-cumylphenol)sulfone (Exmaple 9) instead of the nickel 2,2'-bis(p-tert-octylphenol) sulfone in Example 2 to obtain heat sensitive recording sheets.

The results of performance assessment for the heat sensitive recording sheets obtained in Examples 1 to 3 and the Comparative Example are shown in Table 1, and the results of performance assessment for the heat sensitive recording sheets obtained in Examples 4 to 9 are shown in Table 2.

The results of Examples 1 to 9 show that every color developed image has excellent water resistance.

TABLE 1

| Examples | developed color density (reflectance [I] %) 60 | 80 | 100 | 120 | 140 | 160 | 180 (°C.) | light resistance (degree of residue %) before lightening | 0.5 | 2 | 4 | 6 (hrs.) |
|---|---|---|---|---|---|---|---|---|---|---|---|---|
| Example 1 | 40.5 | 40.0 | 37.5 | 31.5 | 24.0 | 15.5 | 11.5 | 100 | 98.3 | 96.6 | 93.1 | 89.7 |
| Example 2 | 42.5 | 42.0 | 40.0 | 15.0 | 13.0 | 13.0 | 12.5 | 100 | 98 | 92 | 85.7 | 81.6 |
| Example 3 | 40.0 | 40.0 | 25.0 | 14.5 | 11.0 | 10.5 | 9.5 | 100 | 98.9 | 96.0 | 90.5 | 88.5 |
| Comparative Example | — | 38.3 | 24.4 | 15.7 | 10.2 | 9.2 | — | 100 | 97.6 | 79.2 | 25 | — |

| Examples | storage stability (reflectance): sheet before color development, before storage [Ko] | sheet before color development, after 6 months [K] | color developed sheet, before storage [Ko'] | color developed sheet, after 6 months [K'] | water resistance of color developed image: decrease in density of color developed image |
|---|---|---|---|---|---|
| Examples 1 | 88.3 | 87.7 | 15.0 | 15.5 | no decrease in density of color developed image |
| Example 2 | 89.4 | 87.9 | 14.5 | 15.0 | the same as above |
| Example 3 | 86.5 | 85.8 | 14.8 | 15.6 | the same as above |
| Comparative Example | 88.3 | 88.1 | 15.1 | 15.9 | a little decrease |

TABLE 2

| Examples | light resistance (degree of residue %) before lightening | 0.5 | 2 | 4 | 6 (hrs) | storage stability (reflectance): sheet before color development, before storage [Ko] | sheet before color development, after 6 months [K] | color developed sheet, before storage [Ko'] | color developed sheet, after 6 months [K'] | water resistance of colors developed image: decrease in density of color developed image |
|---|---|---|---|---|---|---|---|---|---|---|
| Example 4 | 100 | 98.1 | 96.1 | 94.2 | 90.0 | 89.0 | 87.2 | 15.9 | 16.8 | no decrease in density of color developed image |
| Example 5 | 100 | 93.6 | 91.4 | 89.5 | 87.7 | 89.2 | 86.5 | 17.0 | 18.3 | the same as above |
| Example 6 | 100 | 89.7 | 85.3 | 82.0 | 80.5 | 89.8 | 89.0 | 16.1 | 17.0 | the same as above |
| Example 7 | 100 | 98.7 | 96.8 | 94.1 | 89.8 | 85.1 | 84.0 | 15.5 | 16.0 | the same as above |
| Example 8 | 100 | 93.6 | 89.5 | 83.0 | 80.7 | 89.8 | 88.8 | 15.7 | 16.4 | the same as above |
| Example 9 | 100 | 98.6 | 95.1 | 92.0 | 90.1 | 89.6 | 88.0 | 15.0 | 15.6 | the same as above |

What is claimed is:

1. A heat sensitive recording sheet prepared by coating a developer, coupler which develops a color by a heat fusion reaction with said developer and binder, on a sheet substrate, or by impregnating such therein, characterized in that said developer is one or more than one of the compounds represented by formula (I):

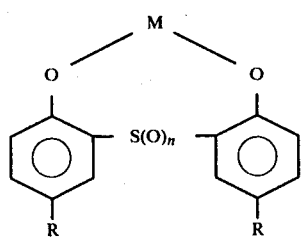

(I)

wherein each R is hydrogen, an alkyl radical of 1 to 12 carbon atoms, a cycloalkyl radical of 3 to 10 carbon atoms, an aralkyl radical of 7 to 10 carbon atoms or a phenyl radical, and can be identical to or different from each other, M is a polyvalent metal, except for Group IA of the Periodic Table, and n is zero or an integer of 1 or 2 and said sheet is substantially colorless at room temperature.

2. The heat sensitive recording sheet claimed in claim 1, wherein M in formula (I) is magnesium, calcium, aluminium, zinc, tin, nickel, cobalt, barium, strontium, cadmium, manganese, or chromium.

3. The heat sensitive recording sheet claimed in claim 2, wherein M in formula (I) is nickel, zinc, cobalt, magnesium, or calcium.

4. The heat sensitive recording sheet claimed in claim 1, wherein R in formula (I) is a tert-butyl, amyl, tert-octyl, nonyl, dodecyl, or cumyl radical.

5. A heat sensitive recording sheet prepared by coating a developer, coupler which develops a color by a heat fusion reaction with said developer and binder, on a sheet substrate, or by impregnating such therein, characterized in that said developer is one or more than one of the compounds represented by formula (I):

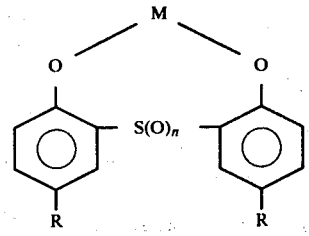

(I)

wherein each R is hydrogen, an alkyl radical of 1 to 12 carbon atoms, a cycloalkyl radical of 7 to 10 carbon atoms or a phenyl radical, and can be identical to or different from each other, M is a polyvalent metal, except for Group IA of the Periodic Table, and n is zero or an integer of 1 to 2, and said sheet further contains a heat fusible material which has a melting point of 50°to 190° C. and is substantially colorless at room temperature.

6. The heat sensitive recording sheet claimed in claim 5, wherein said heat fusible material is acetanilide, urea, diphenylamine, biphenyl, naphthalene, α-naphthol, β-naphthol, bisphenol A, 4,4'-cyclohexilidenediphenol, phthalic anhydride, benzoic acid, phthalic acid, methyl p-hydroxybenzoate, stearic acid, zinc stearate, ethyleneglycol ester stearate, a triphenylphosphate, a 2,2'-bisphenol sulfide, a 2,2'-bisphenolsulfoxide or a 2,2'-bisphenolsulfone.

* * * * *